US005278613A

United States Patent [19]

Bisaiji et al.

[11] Patent Number: 5,278,613

[45] Date of Patent: Jan. 11, 1994

[54] IMAGE FORMING APPARATUS WITH TRANSFER MEDIUM AND ELECTROMETER POSITIONED OPPOSITE THE TRANSFER REGION

[75] Inventors: Takashi Bisaiji, Yokohama; Yasunori Kawaishi, Narashino; Makoto Ohsaki, Yokohama, all of Japan

[73] Assignee: Ricoh Company, Ltd., Tokyo, Japan

[21] Appl. No.: 859,897

[22] Filed: Mar. 30, 1992

[30] Foreign Application Priority Data

Mar. 30, 1991 [JP] Japan ..... 3-093322
Mar. 13, 1992 [JP] Japan ..... 4-055476

[51] Int. Cl.[5] ..... G03G 15/16
[52] U.S. Cl. ..... 355/208; 355/275
[58] Field of Search ..... 355/271, 272, 273, 274, 355/275, 208, 277, 326, 327

[56] References Cited

U.S. PATENT DOCUMENTS

| | | | |
|---|---|---|---|
| 3,837,741 | 9/1974 | Spencer | 355/274 |
| 4,110,031 | 8/1978 | Ebi et al. | 355/274 |
| 4,220,699 | 9/1980 | Ishida et al. | 355/272 X |
| 4,515,460 | 5/1985 | Knechtel | 355/274 X |
| 4,860,048 | 8/1989 | Itoh et al. . | |
| 4,935,776 | 6/1990 | Fukui | 355/274 X |
| 4,984,026 | 1/1991 | Nishise et al. | 355/277 |

FOREIGN PATENT DOCUMENTS

| | | | |
|---|---|---|---|
| 0332223 | 9/1989 | European Pat. Off. . | |
| 0057364 | 4/1985 | Japan . | |
| 0215976 | 9/1987 | Japan . | |
| 0215977 | 9/1987 | Japan . | |
| 0292378 | 11/1989 | Japan | 355/275 |

OTHER PUBLICATIONS

Patent Abstracts of Japan, vol. 7, No. 42 (P-177), Feb. 19, 1983, & JP-A-57-192981, Nov. 27, 1982, Tetsuya Abe, et al., "Copying Paper Separating Method for Electrostatic Copying Machine".

"Electrophotography", R. Schaffert, pp. 61 and 125, 1975.

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

An image forming apparatus which insures stable image transfer at all times with no regard to aging and environment. An electrometer is located in close proximity to and opposite to a transfer region where an image carrier and a transfer medium face each other. A voltage to be applied to an electrode which applies a transfer voltage to the transfer medium is controlled in response to the output of the electrometer such that the electric field in the transfer region remains constant.

13 Claims, 15 Drawing Sheets

IMAGE FORMING APPARATUS WITH TRANSFER MEDIUM AND ELECTROMETER POSITIONED OPPOSITE THE TRANSFER REGION

BACKGROUND OF THE INVENTION

The present invention relates to a laser printer, copier, facsimile transceiver or similar electrophotographic image forming apparatus and, more particularly, to an electrophotographic image forming apparatus of the type having a transfer medium in the form of, for example, a transfer belt.

Conventional image forming apparatuses include one which transfers a toner image from an image carrier to a transfer medium, e.g., a transfer belt by generating an electric field between the image carrier and the belt and then transfers it to a paper sheet or similar transfer material. A prerequisite with this type of apparatus which transfers a toner by an electrostatic force is that an electric field for transfer having a certain value be stably developed in a transfer region. In practice, however, the resistance of the transfer medium changes due to aging and environmental conditions since it is formed of a resistor. To eliminate this problem, the transfer belt may be implemented as an insulating belt, as disclosed in, for example, Japanese Patent Laid-Open Application No. 57364/1985. In this case, the potential of the belt is measured before and after image transfer while transferring means (e.g. transfer charger) is so controlled as to maintain the belt potential constant.

The insulating belt scheme stated above stabilizes image transfer overcoming changes in the electrical characteristics of the transfer medium by controlling the transferring means. However, since the location for measuring the belt potential is remote from the transfer region, the potential deposited on the belt in the transfer region will have been attenuated to some degree when measured by, for example, an electrometer located downstream of the transfer region. In an ordinary condition, the attenuation does not vary beyond a certain range and, therefore, has only to be estimated. However, as the surface of the transfer medium adsorbs moisture in a humid environment, for example, the attenuation increases due to leaks and other similar causes and, in addition, changes with the degree of moisture adsorption. In such a condition, it is extremely difficult to execute accurate control over the transferring means. In light of this, there has been proposed an image forming apparatus which uses a transfer medium in the form of a belt having a resistance of about $10^9$ ohms in order to guarantee a sufficient nip width for transfer and to generate an electric field for transfer efficiency. In this type of apparatus, the image carrier is disposed between a plurality of electrodes which apply transfer voltages to the belt. The transfer voltages from the electrodes generate an electric field in the transfer region where the image carrier and transfer medium, i.e., belt contact each other.

However, by examining a relation between the transfer voltage to be applied to each electrode and the transfer efficiency, it was found that an optimal transfer voltage is not achievable even with the above-described type of apparatus due to aging and environmental factors although it is optimal at first. Specifically, despite that the same transfer voltage is applied to the transfer medium, the same electric field cannot be developed in the transfer region where the transfer medium contacts the image carrier, for the following reasons:

(1) A toner melts and sticks fast to the surface of the transfer medium as the apparatus is repetitively operated; and (2) The resistance of the transfer medium changes due to the influence of ambient conditions (especially humidity).

Moreover, the above occurrences are observed not only over the entire transfer medium but also in limited part of the transfer medium. Specifically, when carbon or similar resistance control agent used to regulate the transfer medium to the above-mentioned particular resistance is dispersed nonuniformily, a current flows in some part and does not flow in some other part. Then, the deterioration of the transfer medium due to aging is not uniform, aggravating the local scattering. The resulting image would suffer from noticeable irregularity.

SUMMARY OF THE INVENTION

It is therefore an object of the present invention to provide an image forming apparatus of the type having a transfer belt or similar transfer medium and insuring stable image transfer with no regard to aging and ambient conditions.

In accordance with the present invention, an image forming apparatus comprises an image carrier, a transfer medium facing the image carrier in a transfer region, an electrode for applying a transfer voltage to the transfer medium at a position other than the transfer region, whereby, while the image carrier and transfer medium are in contact with each other and driven, a toner image formed on the image carrier is transferred to the transfer medium by the transfer voltage and then transferred to a final transfer material, an electrometer located in close proximity to the transfer region where the image carrier and transfer medium face each other, and a voltage control circuit for controlling a voltage to be applied to the electrode in response to an output of the electrometer.

Also, in accordance with the present invention, an image forming apparatus comprises an image carrier, a transfer medium facing the image carrier in a transfer range, an electrode for applying a transfer voltage to the transfer medium at a position other than the transfer region, whereby, while the image carrier and transfer medium are in contact with each other and driven, a toner image formed on the image carrier is transferred to the transfer medium by the transfer voltage and then transferred to a final transfer material, a first electrometer located in close proximity to the transfer region where the image carrier and transfer medium face each other, a second electrometer located upstream of the transfer region of the image carrier for measuring the surface potential of the image carrier, a correcting circuit for correcting the output of the first electrometer by the output of the second electrometer, and a voltage control circuit for controlling the voltage to be applied to the electrode in response to the corrected output of the correcting circuit.

Further, in accordance with the present invention, an image forming apparatus comprises an image carrier, a transfer medium facing the image carrier in a transfer region, an electrode for applying a transfer voltage to the transfer medium at a position other than the transfer region, whereby, while the image carrier and transfer medium are in contact with each other and driven, a toner image formed on the image carrier is transferred to the transfer medium by the transfer voltage and then transferred to a final transfer material, an electrometer located in close proximity to the transfer region where the image carrier and transfer medium face each other, a correcting circuit for correcting the output of the electrometer appeared after the application of a voltage to the electrometer by the output of the electrometer appeared before the application of the voltage, and a voltage control circuit for controlling the voltage to be applied to the electrode on the basis of the corrected output of the correcting circuit.

DESCRIPTION OF THE PREFERRED EMBODIMENTS

Figure 1:
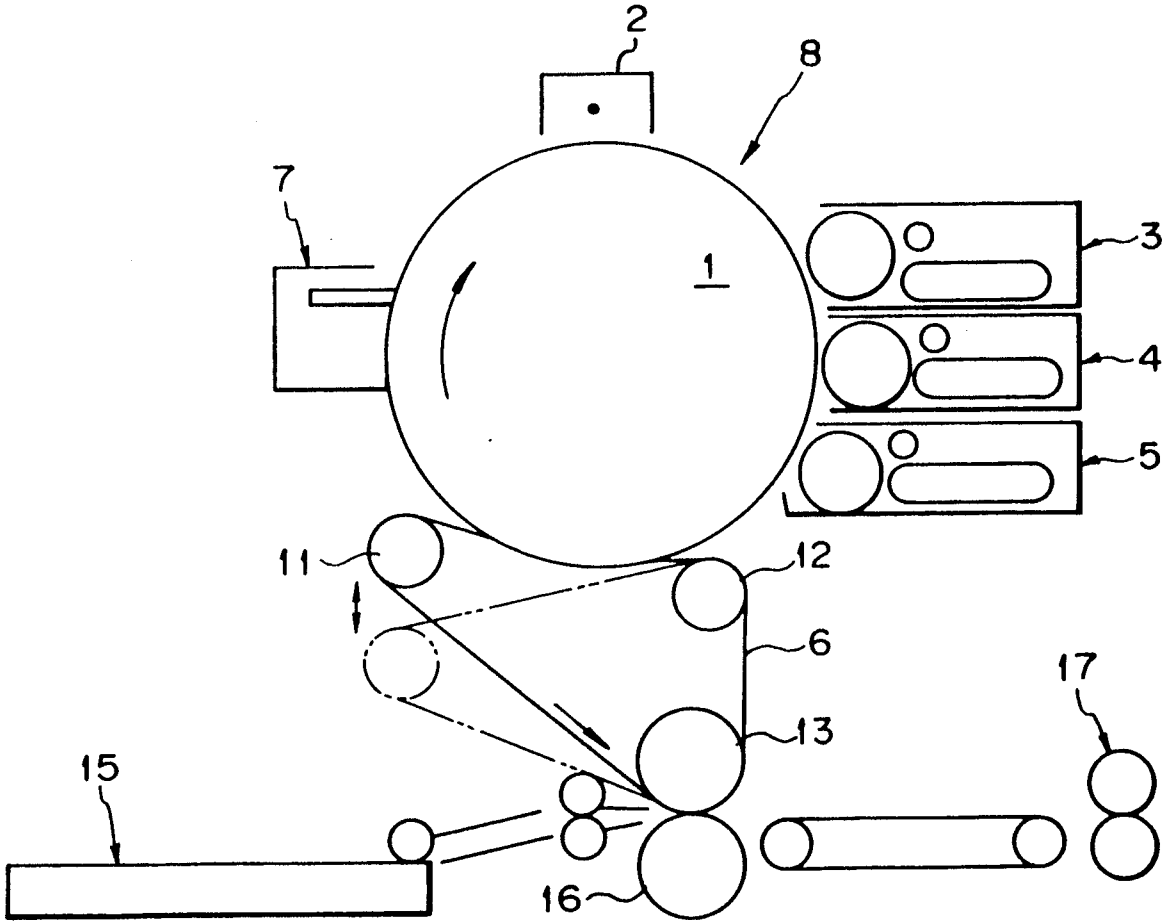
FIG. 1 is a schematic representation of a copier embodying the present invention.

Referring to FIG. 1 of the drawings, an image forming apparatus embodying the present invention is shown and implemented as a copier by way of example. As shown, the copier includes an image carrier in the form of a photoconductive drum 1. Arranged around the drum 1 are a charger 2, a cyan developing unit 3, a magenta developing unit 4, a yellow developing unit 5, a transfer belt 6, and a cleaning unit 7. The cyan, magenta and yellow developing units 3, 4 and 5 store respectively cyan, magenta and yellow toners and transport the respective toners to the drum 1 for development.

While the drum 1 is rotated by a motor, not shown, in a direction indicated by an arrow, the charger 2 uniformly charges the surface of the drum 1. A reflection from a document laid on a glass platen, not shown, is separated into color components by a color filter. First, light 8 transmitted through the color filter illuminates an area of the charged surface of the drum 2 which should be developed in cyan, thereby forming a cyan latent image. The cyan developing unit 3 develops the latent image by the cyan toner to produce a toner image. The transfer belt 6 is passed over two electrode rollers 11 and 12 and a paper transfer roller 13. When a bias voltage is applied to the electrode rollers 11 and 12 which hold the surface of the drum 11 therebetween, an electric field is developed in a transfer region where the belt 6 contacts the drum 1. As a result, the cyan image is transferred from the drum 1 to the transfer belt 6. The cleaning unit 7 removes the toner which remains on the drum 1 after the image transfer, and then a charge removing lamp, not shown, dissipates the charge remaining on the drum 1. The drum 1 is now ready to undergo another image forming cycle.

Subsequently, light 8 from the color filter exposes another area of the charged surface of the drum 1 which should be developed in magenta to thereby form a magenta latent image. The magenta developing unit 4 develops the latent image to produce a magenta toner image. The magenta toner image is transferred to the transfer belt 6 over the cyan image. This is followed by the above-mentioned drum cleaning operation. Thereafter, the light 8 from the color filter exposes another area of the drum 1 which should be developed in yellow, thereby forming a yellow latent image. The yellow developing unit 5 develops the latent image to produce a yellow toner image. The yellow toner image is transferred to the transfer belt 6 over the cyan and magenta images existing on the belt 6. As a result, a full color image is completed on the transfer belt 6.

A recording medium, e.g., a paper sheet is fed from a paper feed unit 15. As a voltage is applied to the paper transfer roller 16, the full color image is transferred from the transfer belt 6 to the paper sheet. A fixing roller 17 fixes the image on the paper sheet. The resulting color copy is driven out of the copier.

In the illustrative embodiment, the electrode roller 11 is movable in a direction indicated by an arrow by being driven by a mechanism, not shown. Specifically, the electrode roller 11 is moved from a phantom line position to a solid line position in the event of image formation and the adjustment of the voltage to the roller 11, which will be described. In the solid line position, electrode roller 11 urges the transfer belt 6 against the drum 1.

Figure 2:
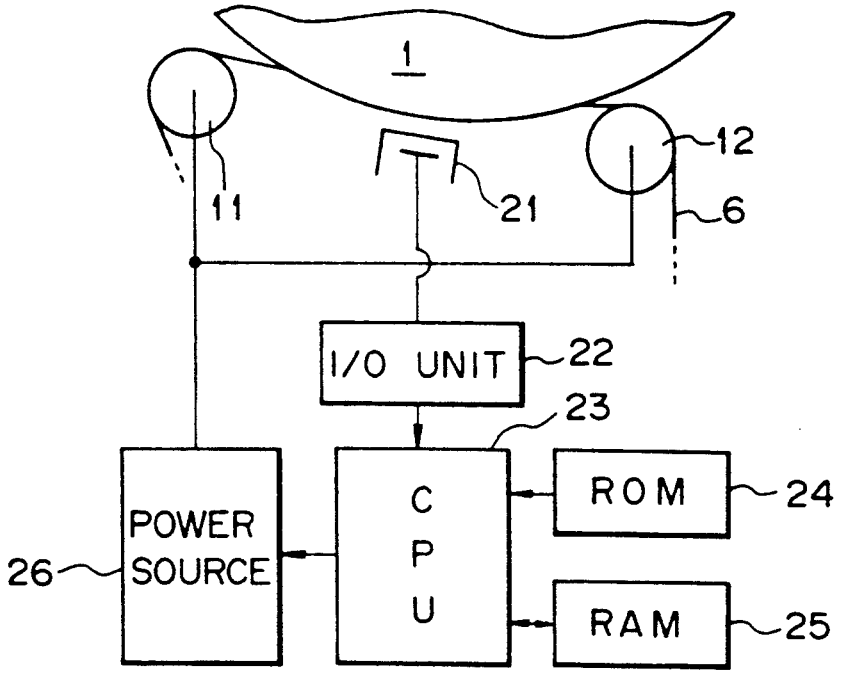
FIG. 2 is a block diagram schematically showing essential parts of a control system incorporated in the embodiment.
Figure 3:
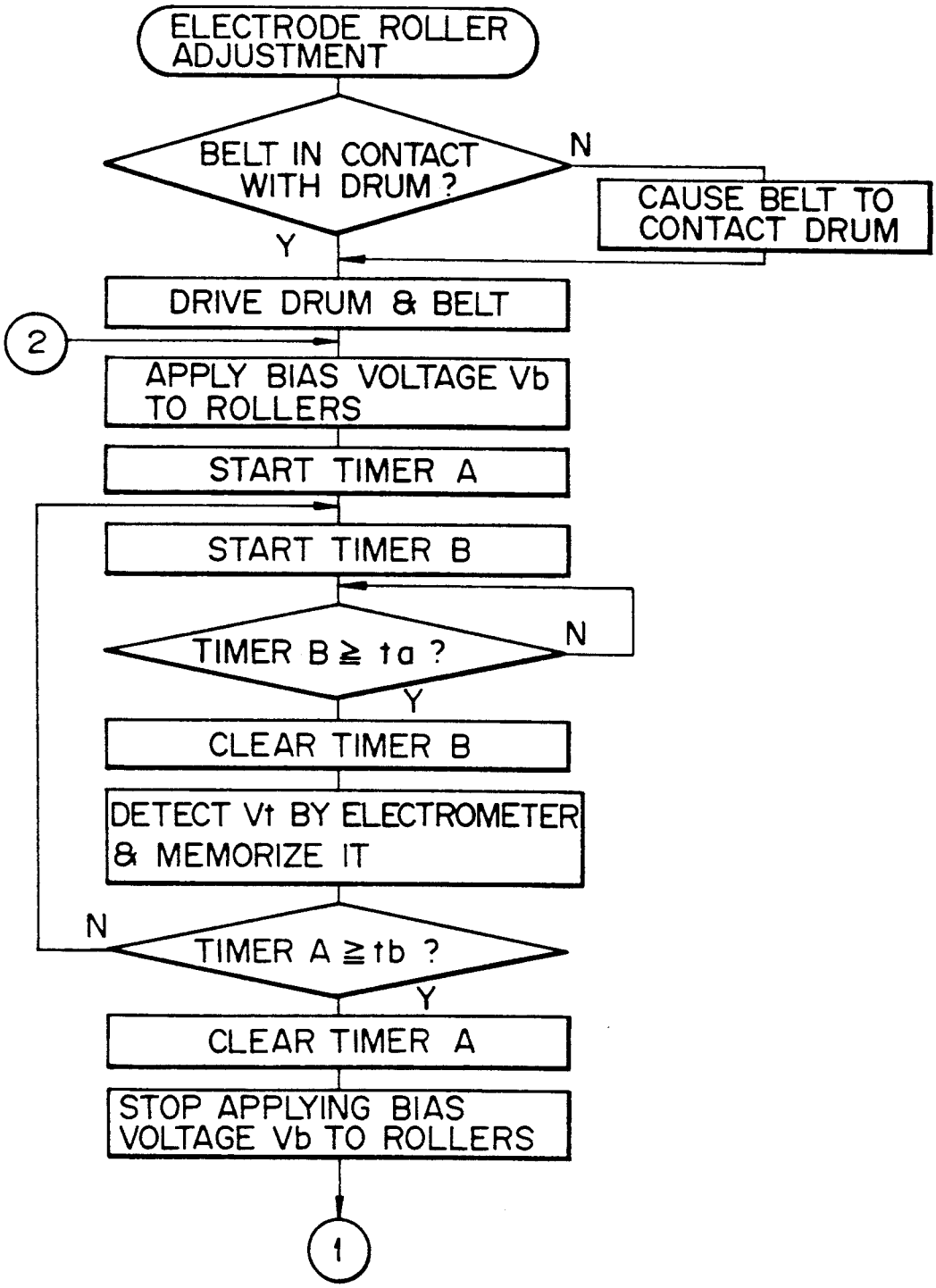
FIG. 3 is a flowchart representative of part of a specific electrode roller adjustment procedure particular to the embodiment.
Figure 4:
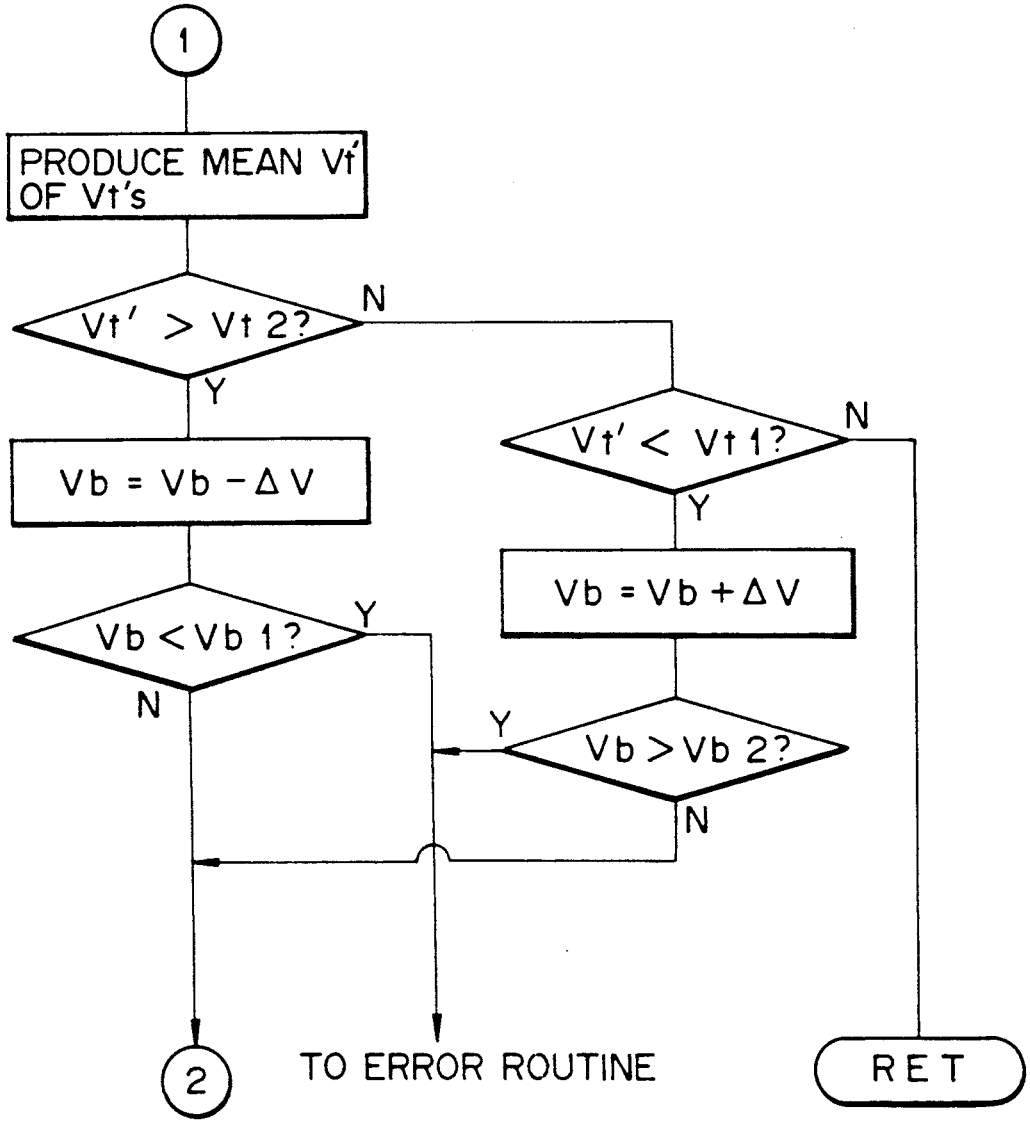
FIG. 4 is a flowchart showing another part of the specific electrode roller adjustment procedure.

FIG. 2 shows essential part of a control system incorporated in the copier. Although not shown in FIG. 1, an electrometer 21 is located between the electrode rollers 11 and 12 to face the rear (transfer region) of the transfer belt 6. The output of the electrometer 21 is converted to digital data by an I/O (Input/Output) unit 22 and then fed to a CPU (Central Processing Unit) 23 as data Vt. By using a ROM (Read Only Memory) 24 and a RAM (Random Access Memory) 25, the CPU 23 controls the bias voltage to be applied from a power source 26 to the electrode rollers 11 and 12, so that the input digital data Vt may remain constant. Such a routine to be executed by the CPU 23 will be described with reference to FIGS. 3 and 4.

As the copier enters into an electrode roller adjust mode at the start-up of operation (turn-on of a power switch) or on completing a particular job, the routine which will be described is called by a main routine, not shown. First, the CPU 23 determines whether or not the transport belt 6 is in contact with the drum 1. If the belt 6 is out of contact with the drum 1, the CPU 23 raises the electrode roller 11 to the solid line position shown in FIG. 1 to thereby bring the belt 6 into contact with the drum 1. Thereafter, the CPU 23 drives the drum 1 and belt 6. Subsequently, the CPU 23 applies a bias voltage Vb to the electrode rollers 11 and 12 while starting timers A and B built therein. When the timer B counts up a predetermined period of time ta stored in the ROM 24 (i.e. a unit period of time for the potential of the belt 6 to be sampled at a predetermined pitch over one full rotation of the belt 6), the CPU 23 clears the timer B. At the same time, the CPU 23 reads the instantaneous output of the electrometer 21, i.e., data Vt via the I/O unit 22 and writes it in the RAM 25. Then, the CPU 23 determines whether or not the timer A has counted a predetermined period of time tb also stored in the ROM 24 (i.e. a period of time necessary for the belt 6 to complete at least one rotation).

Figure 5:
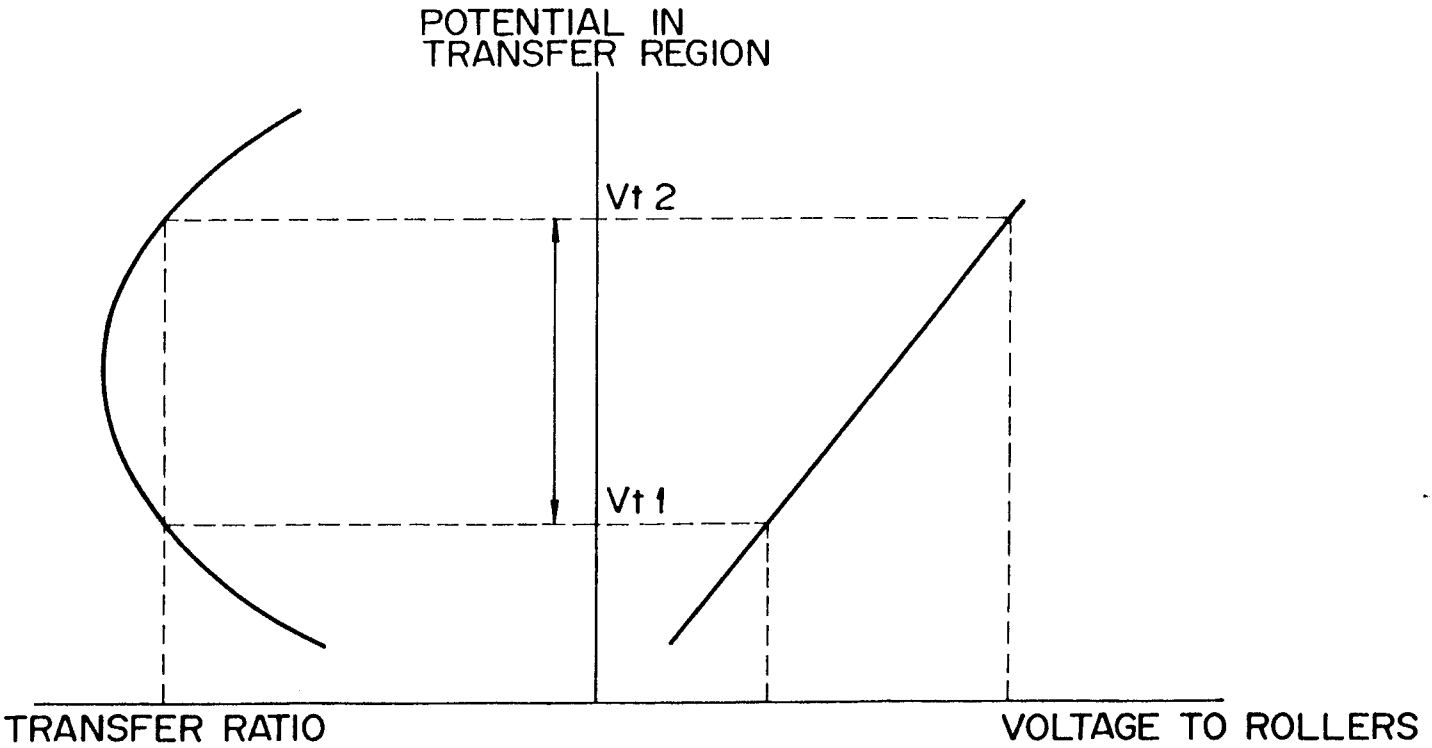
FIG. 5 is a graph indicative of a relation of a potential between electrode rollers shown in FIG. 1, a potential in a transfer region, and a transfer ratio to one another.

If the timer A has not reached the period of time tb, the CPU 23 again starts the timer B and then repeats the above sequence of steps. As the timer A counts up the period of time tb, the CPU 23 clears the timer A and stops applying the bias voltage Vb to the electrode rollers 11 and 12. The CPU 23 produces a mean of the data Vt having been sequentially written to the RAM 25 (potentials of the transfer region) and compares the resulting mean Vt' with two reference values $Vt_1$ and $Vt_2$ stored in the ROM 24. The reference values $Vt_1$ and $Vt_2$ are respectively representative of a lower limit and an upper limit of a reference potential range which allows images to be desirably transferred, as shown in FIG. 5. When the mean data or potential Vt' is smaller than the reference value $Vt_1$, the CPU 23 increases the bias potential Vb by a predetermined value $\Delta V$ determining that the electric field in the transfer region is short. Then, the CPU 23 determines whether or not the increased bias voltage Vb lies in a controllable potential range and, if the result of decision is negative, i.e., if the bias voltage Vb has exceeded an upper limit $Vb_2$ of the controllable potential range, starts on an error mode and executes an error process routine, not shown. If otherwise, the CPU 23 applies the increased bias voltage Vb to the electrode rollers 11 and 12. This is followed by the same procedure as described above.

On the other hand, if the mean data Vt' is greater than the reference value $Vt_2$, the CPU 23 lowers the bias voltage to be applied to the electrode rollers 11 and 12 by the predetermined value $\Delta V$ determining that the electric field in the transfer region is excessive. Then the CPU 23 determines whether or not the reduced bias voltage Vb lies in the controllable potential range. If the result of this decision is negative, i.e., if the reduced voltage Vb is lower than a lower limit $Vb_1$ of the controllable potential range, the CPU 23 again starts on the error process routine; if otherwise, the CPU 23 applies the bias voltage Vb to the electrode rollers 11 and 12.

In the error process routine, the CPU 23 may interrupt the rotation of the machine or display a corresponding message on a display, not shown.

As stated above, in the above embodiment, the output Vt of the electrometer is sampled at a predetermined pitch while the drum 1 is in contact with the transfer belt 6 and while the belt 6 completes at least one full rotation. The mean Vt' of the sampled values is compared with the upper and lower limits of the predetermined reference potential range. When the mean Vt' is lower than the lower limit, the voltage to be applied to the electrode rollers 11 and 12 is increased by a predetermined value. When the mean Vt' is higher than the upper limit, the voltage of interest is reduced by the predetermined value. As a result, the mean Vt' is confined in the reference potential range. This is successful in maintaining the electric field in the transfer region where the drum 1 and belt 6 contact constant and, therefore, in insuring stable image transfer with no regard to aging or environmental conditions.

Further, the bias voltage Vb to be applied to the electrode rollers 11 and 12 is compared with the upper and lower limits of the controllable potential range and, if it lies in such a range, the voltage to the rollers 11 and 12 can be continuously adjusted. Once the bias voltage Vb is brought out of the controllable potential range, the program enters into an error mode to inform the operator of such an occurrence. The program is, therefore, prevented from falling into a closed loop due to unsuccessful control or from applying an excessive voltage to the electrode rollers 11 and 12 which would be harmful to the copier and operator.

If desired, an arrangement may be made such that the outputs of the electrometer 21 having appeared during the one rotation of the transfer belt 6 may be integrated or smoothed to control the bias voltage to the electrode rollers 11 and 12 on the basis of the resulting value. Another possible arrangement is such that the bias voltage to the electrode rollers 11 and 12 is adjusted in response to the outputs of the electrometer 21 at predetermined timings during one rotation of the belt 6.

When a bias electrode is applied to the electrode rollers 11 and 12, the drum 1 is charged to polarity opposite to the polarity of the bias voltage. This is presumably because a discharge occurs due to the gap between the drum 1 and the transfer belt 6. In such a condition, should the electrometer 21 detect the potential in the transfer region of the transfer belt 6, it would detect the potential of the drum 1 also, failing to perform accurate measurement. In light of this, it is preferable to include a step of regulating the surface of the drum 1 to a predetermined potential (e.g. residual potential level) while the transfer belt 6 is spaced apart from the drum 1. For this purpose, the surface of the drum 1 may be uniformly charged by the charger 2 or a precleaning charger, not shown, or uniformly exposed by a laser beam or similar light.

Figure 6:
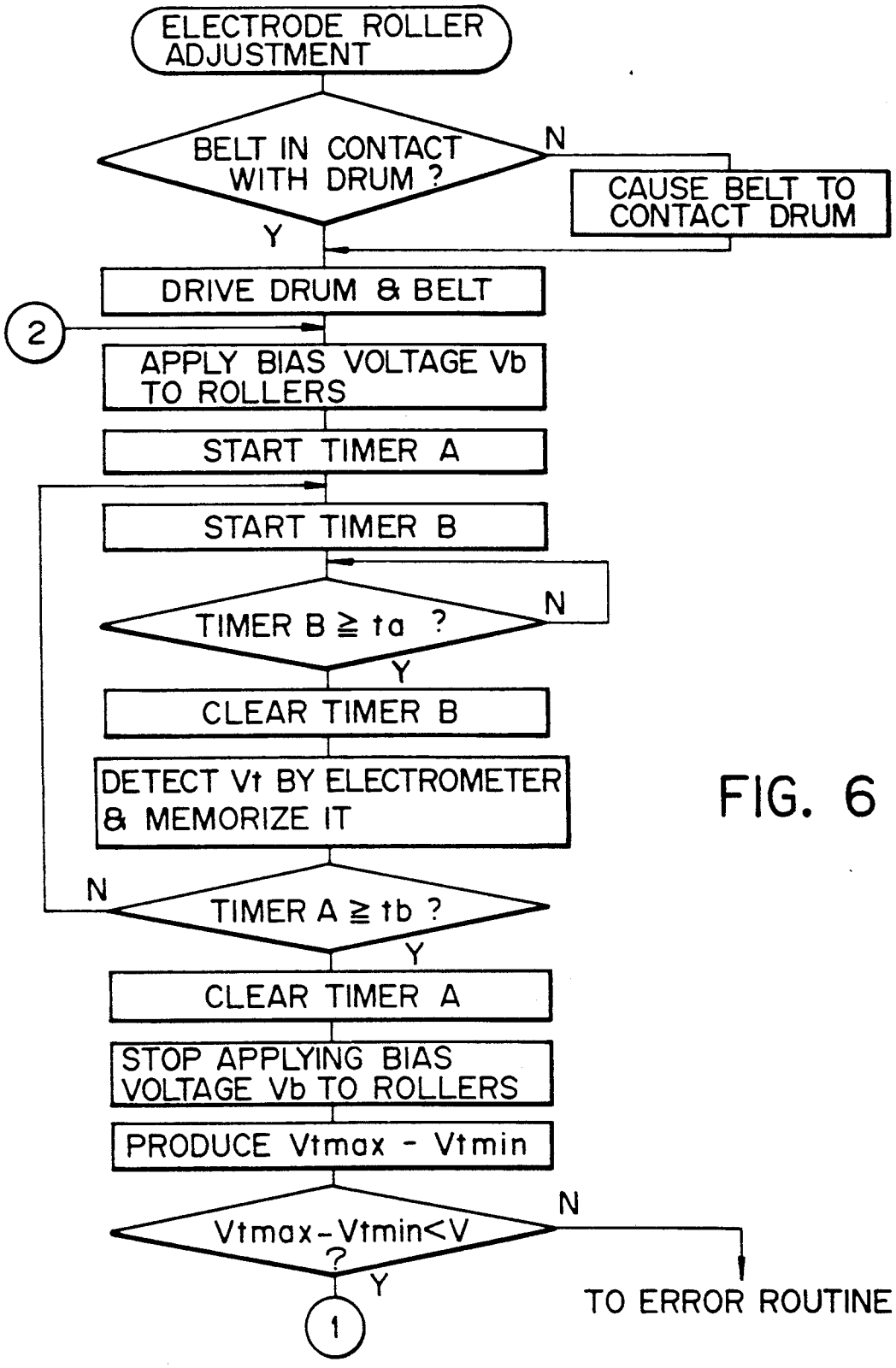
FIG. 6 is a flowchart showing another specific electrode roller adjustment procedure representative of an alternative embodiment of the present invention.

Referring to FIG. 6, a specific operation representative of an alternative embodiment of the present invention is shown and also executed by the CPU 23. Since this operation is also practicable with the hardware shown in FIGS. 1 and 2, the following description will be made with reference to such figures. While the drum and transfer belt 6 are in contact with each other, the output Vt of the electrometer 21 is sampled at a predetermined pitch and memorized, as in the procedure of FIG. 3. After the CPU 32 has stopped applying the bias voltage to the electrode rollers 11 and 12, it picks up the maximum value Vtmax and minimum value Vtmin out of the consecutive data Vt stored in the RAM 25 and calculates a difference Vtmax−Vtmin. Then, the CPU 32 compares the resulting difference with the difference between the upper limit $Vt_2$ and the lower limit $Vt_1$, i.e., controllable potential range V ($Vt_2-Vt_1$). If the difference Vtmax−Vtmin is smaller than V, the CPU 32 executes the step of producing a mean of the data Vt stored in the RAM 25 and successive steps, as in FIG. 3. If the former is greater than or equal to the latter, the CPU 23 starts on an error process routine.

Figure 7A:
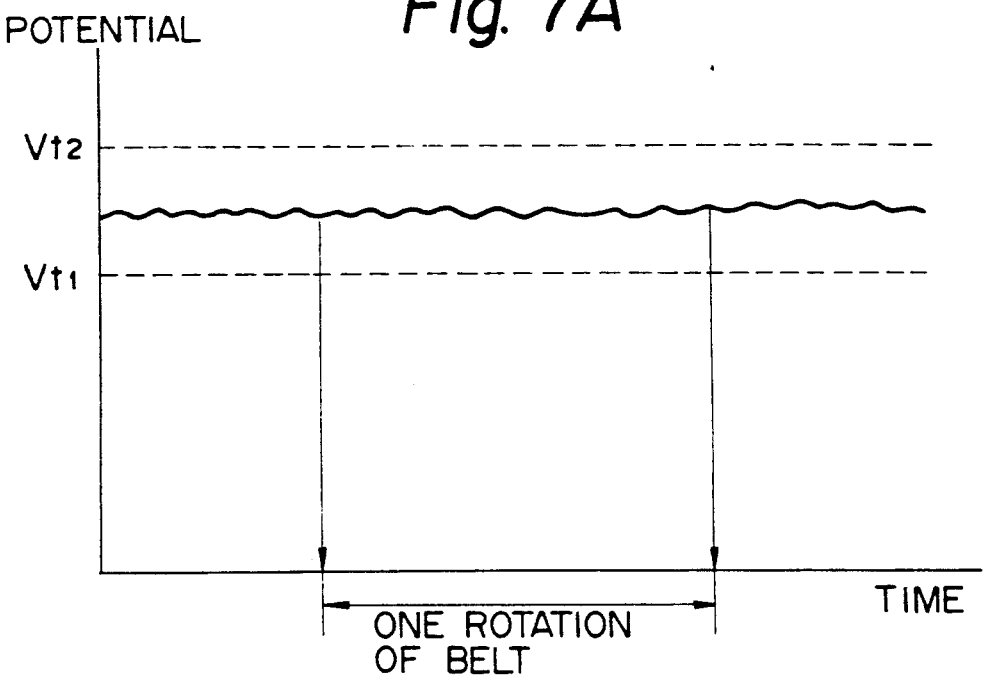
FIGS. 7A and 7B are graphs useful for understanding the procedure shown in FIG. 6.
Figure 7B:
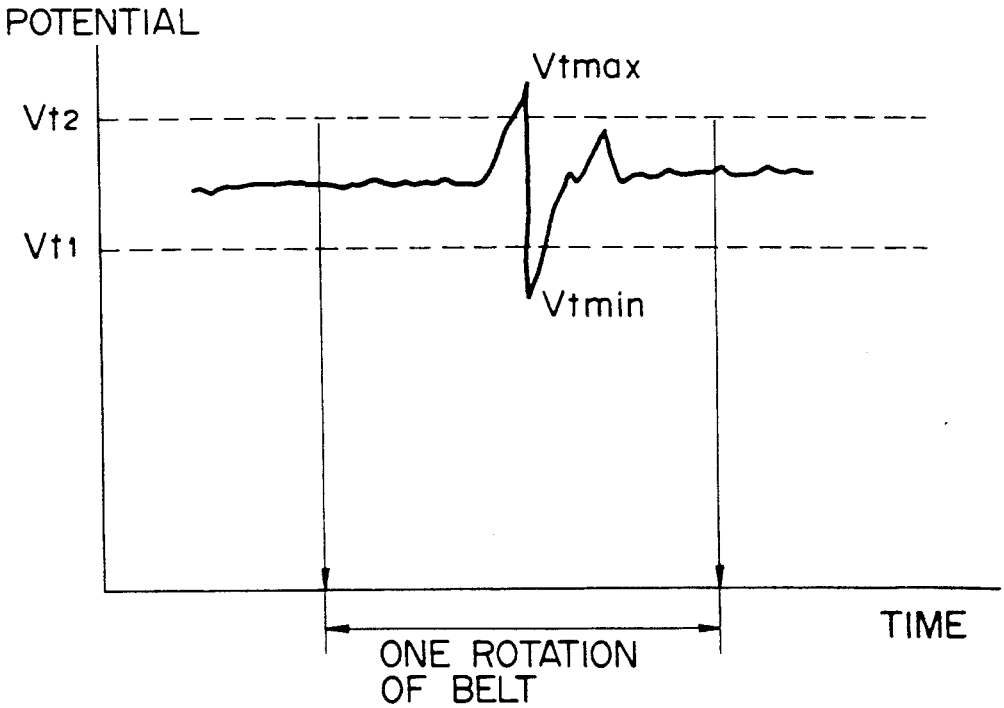

FIGS. 7A and 7B show respectively the scattering of the potential in the transfer region measured when the transfer belt 6 was not faulty and the scattering of the same measured when it was faulty, with respect to one full rotation of the belt 6. As these figures indicate, even though the mean potential may lie in the controllable potential range V ($Vt_2-Vt_1$), a desirable image is not achievable if even part of the potential variation does not lie in such a range. In this embodiment, the controllable potential range V is set in the ROM 24 beforehand and compared with the output of the electrometer 21 to see if it is acceptable.

The illustrative embodiment is capable of detecting electrical faults of the transfer belt 6, e.g., irregular resistance distribution by determining the maximum and minimum values of the output of the electrometer 21 and, in a faulty condition of the kind undesirable for image transfer, sets up an error mode. The embodiment, therefore, not only achieves the advantages described in relation to the previous embodiment but also prevents faulty images from being produced.

Figure 8:
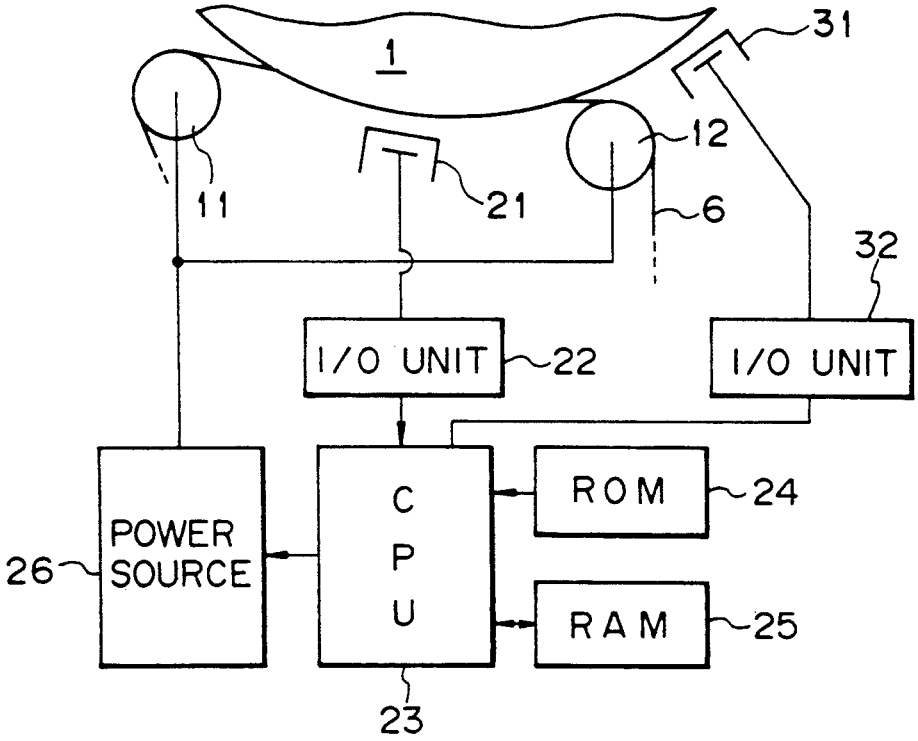
FIG. 8 is a schematic block diagram of a control system representative of another embodiment of the present invention.

FIG. 8 shows a control system representative of another alternative embodiment of the present invention which is essentially similar to the control system of FIG. 2. In the figures, the same or similar components are designated by like reference numerals, and redundant description will be avoided for simplicity. As shown, an electrometer 31 is located upstream of the transfer region of the drum 1 (where the drum 1 contacts the transfer belt 6). The output of the electrometer 31 is digitized by an I/O unit 32 and the fed to the CPU 23 as data Vpc.

Specifically, since the potential of the drum 1 has influence on the transfer potential, it is preferable to regulate the surface of the drum 1 to a predetermined potential, as stated earlier. However, the predetermined potential itself is likely to change due to a change in the characteristic of the drum 1 ascribable to aging or environment. In light of this, the embodiment uses the electrometer 31 responsive to the surface potential of the drum 1 in addition to the electrometer responsive to the potential in the transfer region and corrects the transfer potential on the basis of the output of the electrometers.

Figure 9:
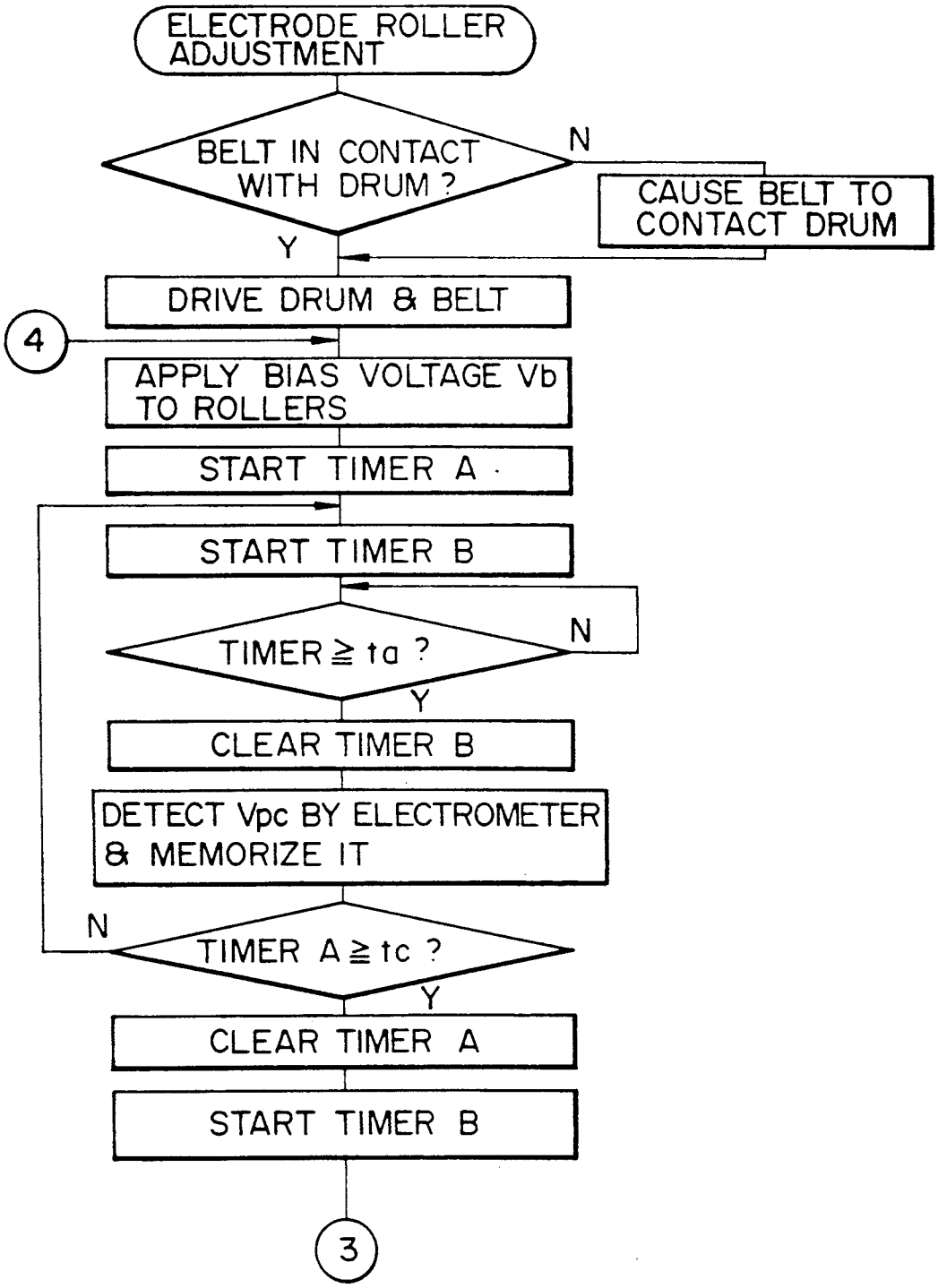
FIG. 9 is a flowchart demonstration another specific electrode roller adjustment procedure particular to the embodiment of FIG. 8.
Figure 10:
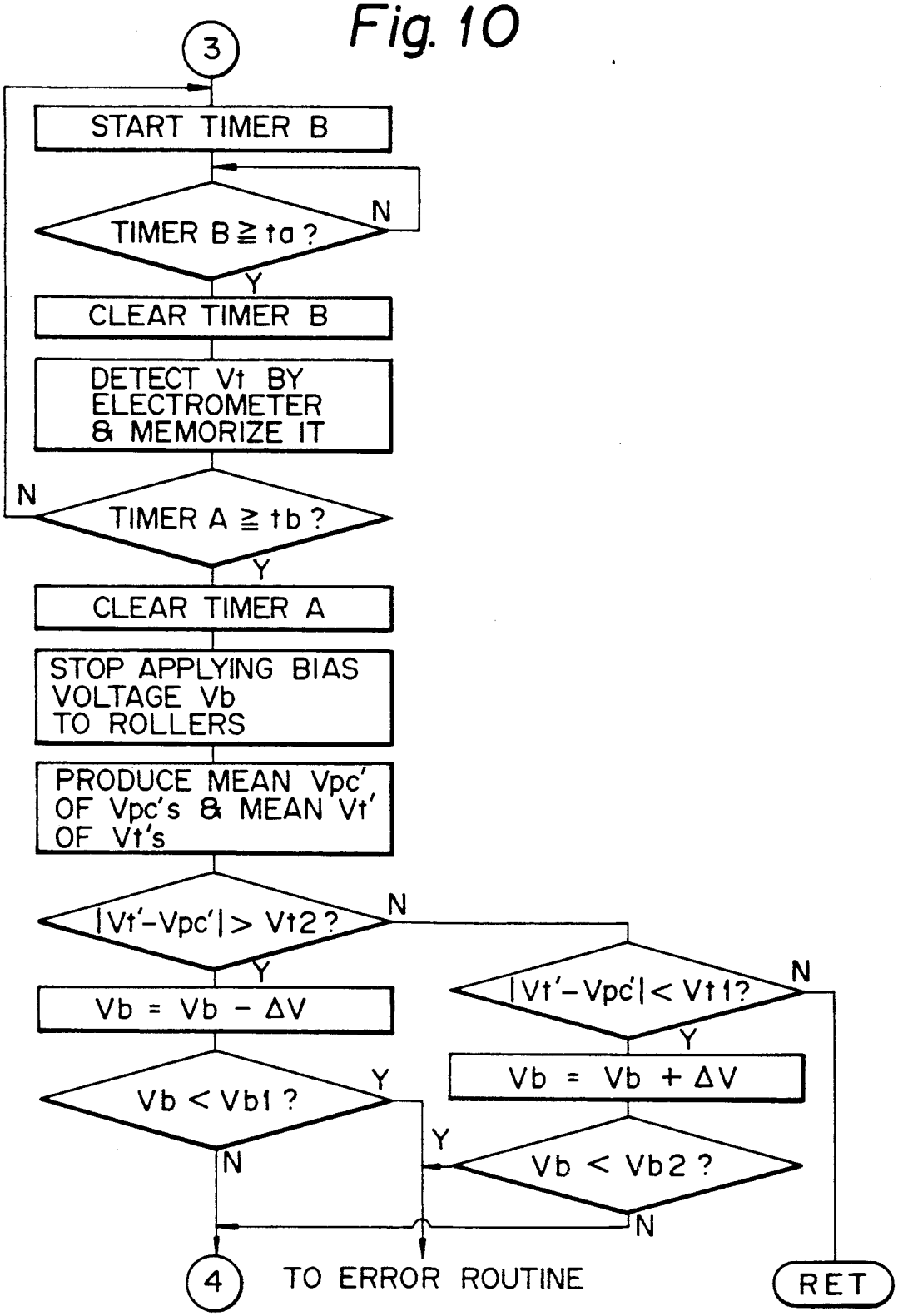
FIG. 10 is a flowchart associated with the flowchart of FIG. 9.

In detail, as shown in FIGS. 9 and 10, the CPU 23 applies a bias voltage Vb to the electrode rollers 11 and 12 and then memorizes the outputs of the electrometer 31, i.e., surface potentials Vpc appearing at a predetermined pitch during at least one full rotation of the drum 1 by use of the timers A and B. Subsequently, the CPU 23 detects and memorizes the potential Vt in the transfer region at a predetermined pitch by the electrometer 21 while the transfer belt 6 completes at least one rotation. After interrupting the bias voltage V to the electrode rollers 11 and 12, the CPU 23 produces a mean Vpc' of detected Vpc's and a mean Vt' of detected Vt's. Then, the CPU 23 determines a difference between Vt' and Vpc' ($|Vt'-Vpc'|$) to be the substantial transfer voltage, compares the difference or voltage with the upper and lower limits of the reference potential range, and then changes the bias voltage Vb to be applied to the electrode rollers 11 and 12, as in the previous embodiments.

This embodiment further enhances stable image transfer since it can maintain the electric field in the transfer region constant with no regard to the potential of the drum 1.

Figure 11:
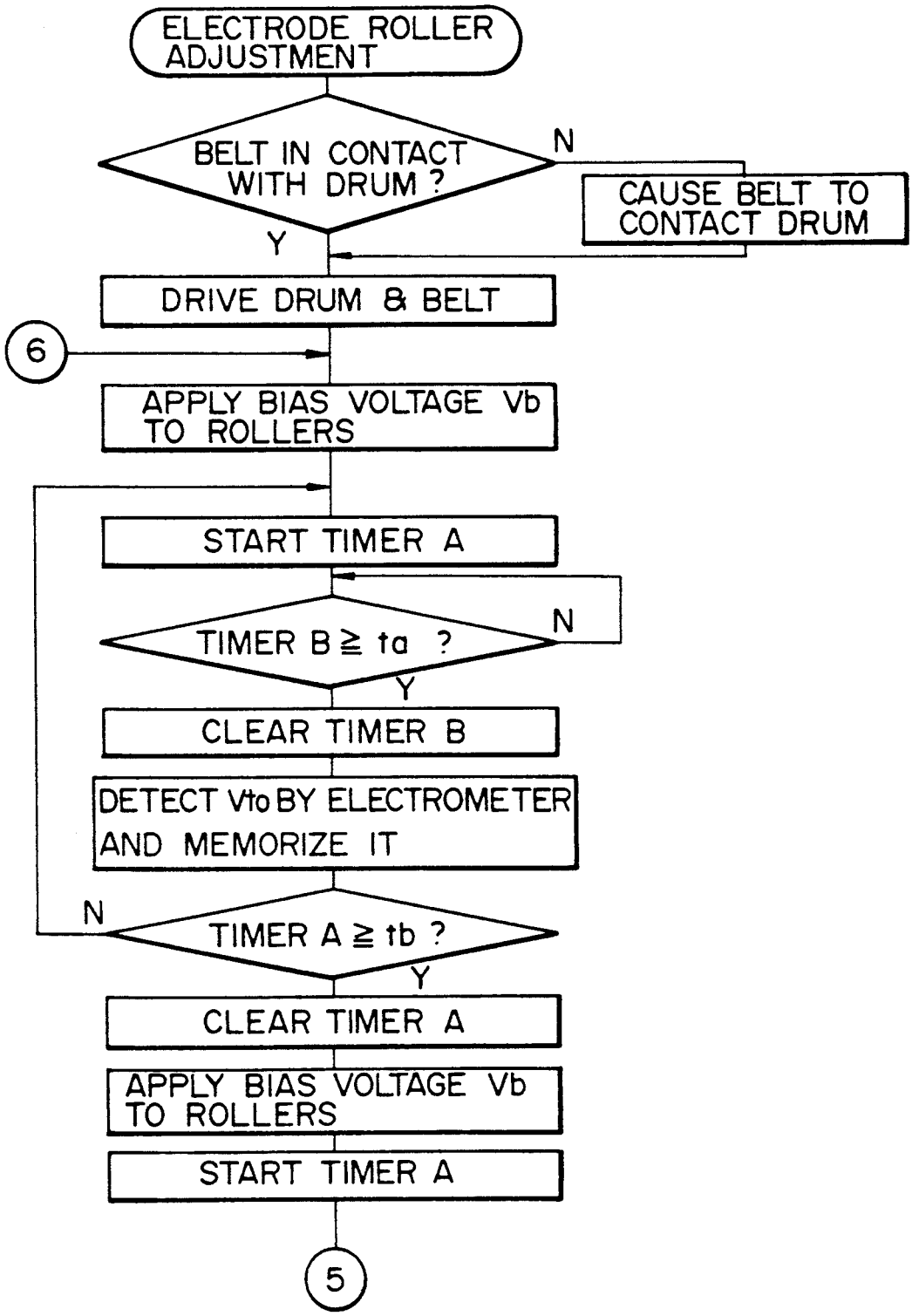
FIG. 11 is a flowchart showing another specific electrode roller adjustment procedure representative of still another embodiment of the present invention.
Figure 12:
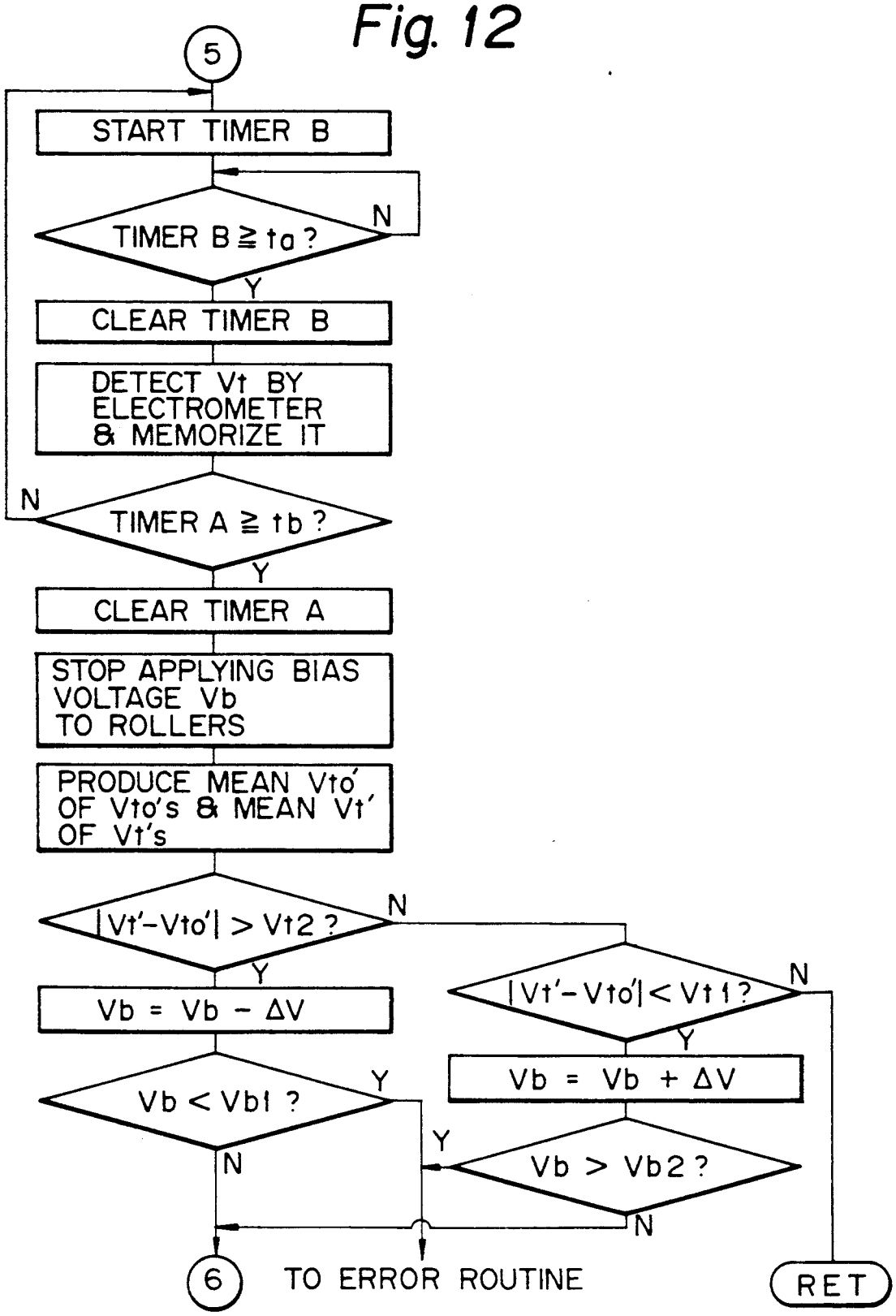
FIG. 12 is a flowchart associated with the flowchart of FIG. 11.

Referring to FIG. 11 and 12, another specific operation representative of a further alternative embodiment of the present invention is shown. This embodiment is also practicable with the hardware shown in FIGS. 1 and 2. As shown, while the drum 1 and transfer belt 6 are in contact with each other, the potential $Vt_o$ in the transfer region is sampled at a predetermined pitch by the electrometer 21 during at least one rotation of the belt 6, prior to the application of a bias voltage to the electrode rollers 11 and 12. After a bias voltage has been applied to the electrode rollers 11 and 12, the electrometer 21 samples the potential Vt in the transfer region at a predetermined pitch during at least one rotation of the belt 6. The CPU 23 produces a mean $Vt_o'$ of the sampled $Vt_o$'s and a mean Vt' of the sampled Vt's, determines a difference between Vt' and $Vt_o'$ ($|Vt'-Vt_o'|$) to be the substantial transfer voltage, compares the difference of potential with the upper and lower limits of the reference potential range, and then, for example, changes the bias voltage Vb to be applied to the electrode rollers 11 and 12, as in the previous embodiments.

The above embodiment, therefore, maintains the electric field in the transfer range constant by eliminating the influence of the potential of the drum 1 and the potential remaining on the transfer belt 6, thereby insuring much more stable image transfer.

Figure 13:
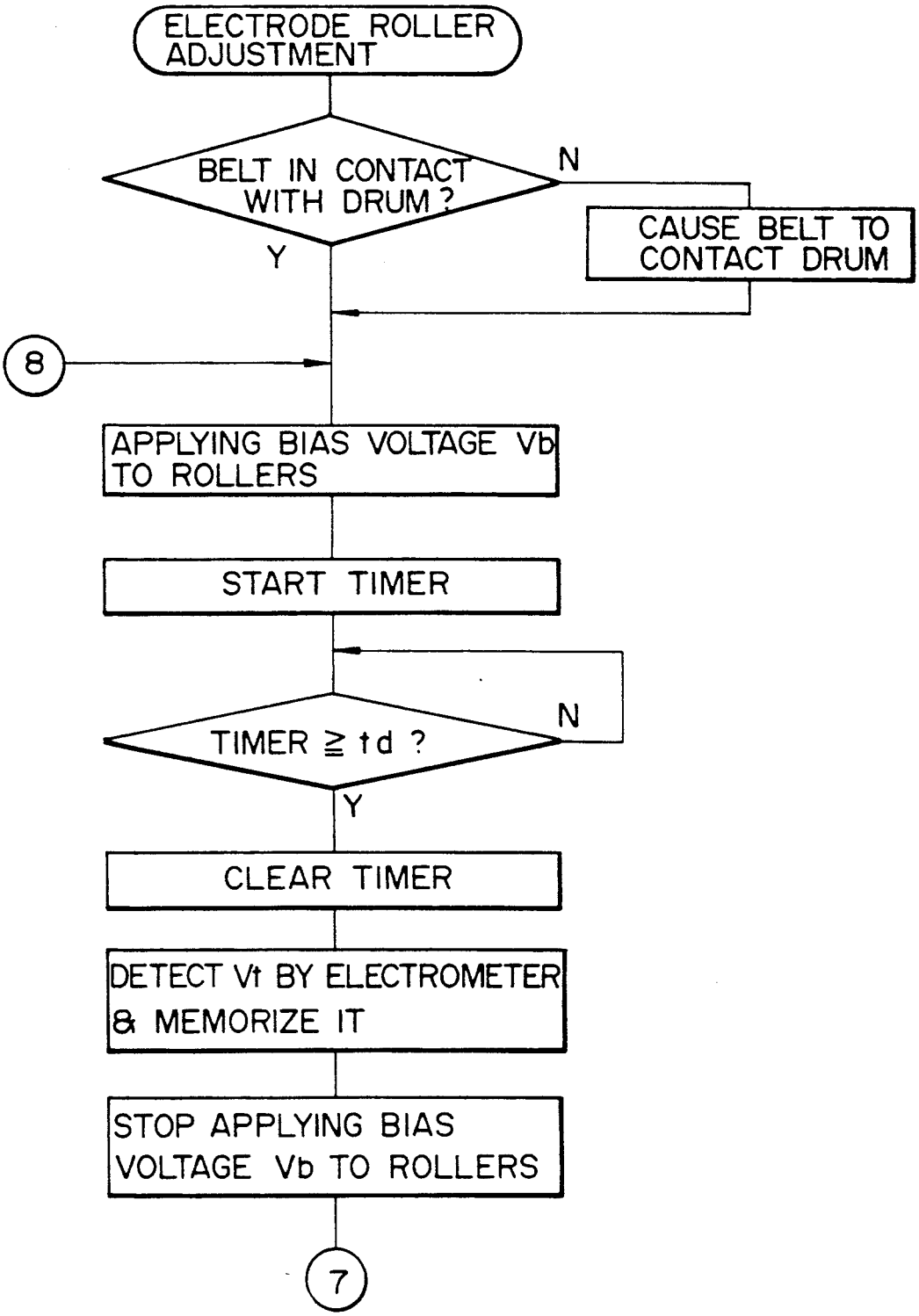
FIG. 13 is a flowchart showing another specific electrode roller adjustment procedure representative of a further alternative embodiment of the present invention.
Figure 14:
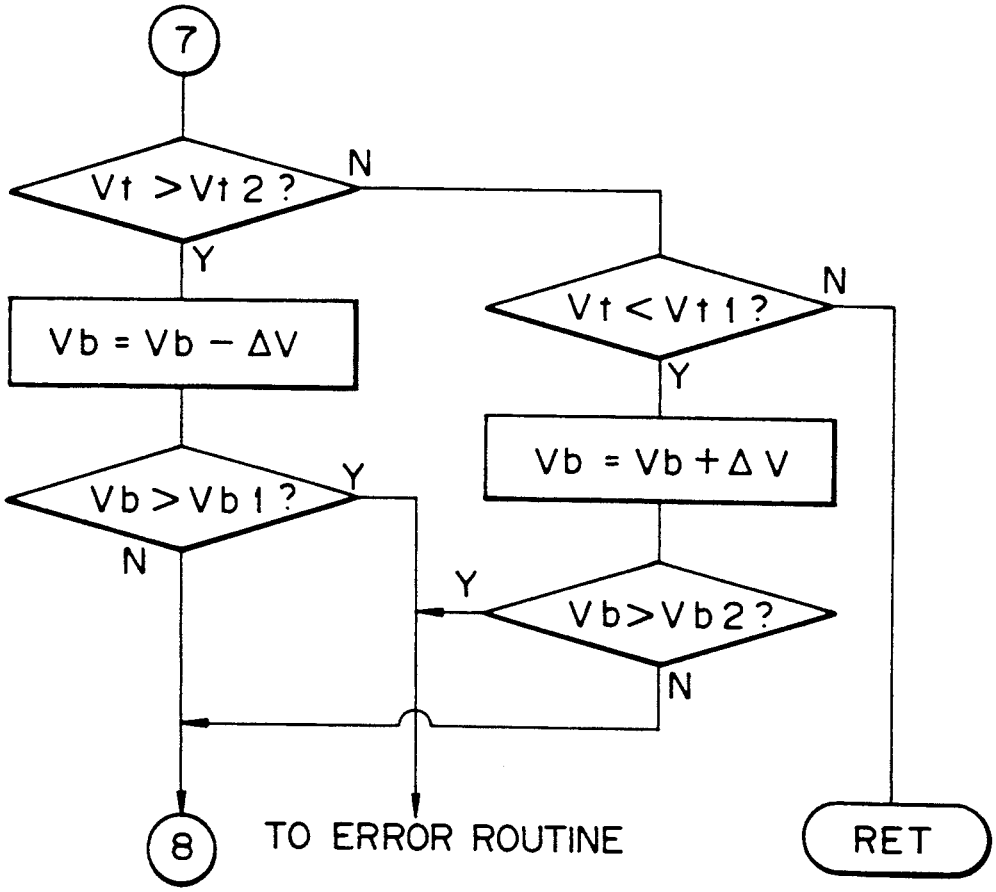
FIG. 14 is a flowchart associated with the flowchart of FIG. 13.
Figure 15:
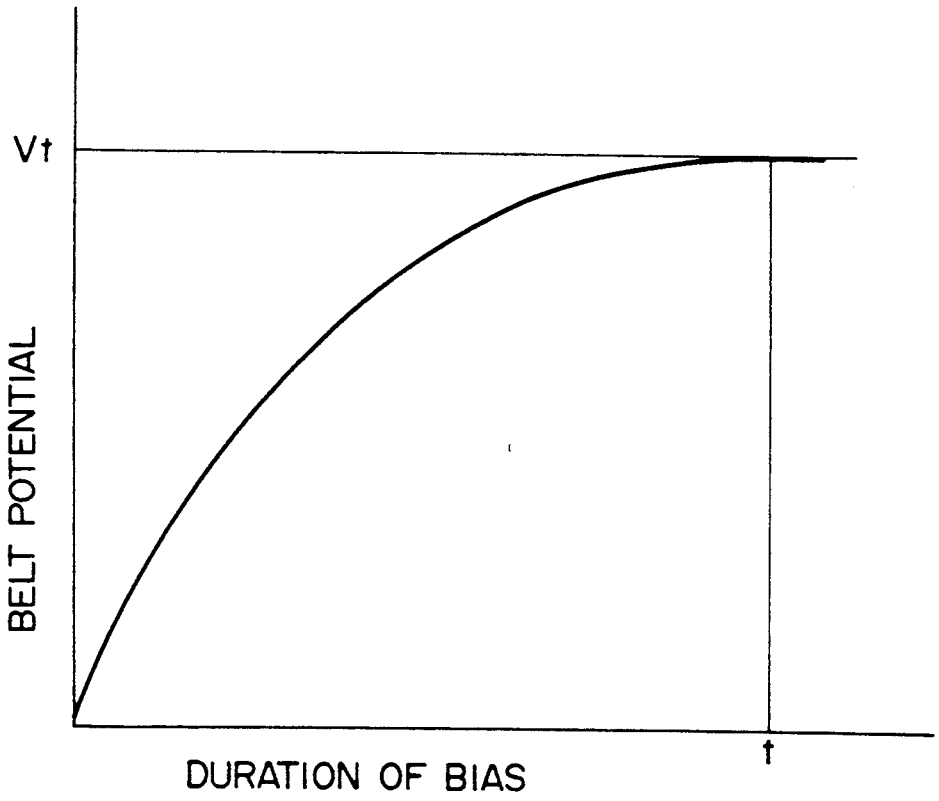
FIG. 15 is a graph indicative of a relation between the duration of bias voltage application to electrode rollers included in the embodiment of FIG. 13 and the transfer region (belt potential).

Yet another alternative embodiment of the present invention which will be described is also practicable with the hardware shown in FIGS. 1 and 2. This embodiment detects the potential in the transfer region while the drum 1 and transfer belt 5 are in contact with each other and held stationary. In the stationary condition, it is possible to determine whether or not an effective electric field is developed in the image transfer step by detecting how the potential in the transfer region (belt potential) rises, as shown in FIG. 15. Specifically, as shown in FIGS. 13 and 14, while the drum 1 and belt 6 are held in the above-mentioned condition, the CPU 23 applies a bias voltage Vb to the electrode rollers 11 and 12 and starts a timer C built therein. When the timer C counts up a predetermined period of time td stored in the ROM 24 (necessary for the potential Vt in the transfer region to reach the reference potential range), the CPU 23 measures the potential Vt in the transfer region by the electrometer 21. It is to be noted that on the elapse of the period of time td the potential in the transfer region may be detected either by direct measurement or by use of an approximation equation (generally recurred by an exponential function) derived from some sampling data. After the above procedure, the CPU 23 stops applying the bias voltage Vb to the electrode rollers 11 and 12, compares the value Vt with the upper and lower limits of the reference potential range, and then, for example changes the bias voltage Vb to be applied to the rollers 11 and 12.

This embodiment, like the previous embodiments, is capable of promoting stable image transfer.

If desired, the various portions of the electrode roller adjustment procedures described above may be combined in a suitable way to promote further effective control over the bias voltage.

While the embodiments each applies a bias voltage to both of the electrode rollers 11 and 12 located upstream and downstream of the drum 1, the bias voltage may, of course, be applied to only one of the rollers 11 and 12.

The present invention is applicable not only to a copier but also to other various kinds of image forming apparatuses including optical printers, e.g., laser printer, LED (Light Emitting Diode) printer and liquid crystal shutter printer, and a facsimile transceiver.

In summary, it will be seen that the present invention provides an image forming apparatus which insures stable image transfer with no regard to aging and environmental conditions. This unprecedented advantage is derived from the fact that the invention locates an electrometer in close proximity to a transfer region where an image carrier and a transfer medium face each other and controls, in response to the output of the electrometer, a voltage to be applied to an electrode in such a manner as to maintain the electric field in the transfer region constant.

Various modifications will become possible for those skilled in the art after receiving the teachings of the present disclosure without departing from the scope thereof.

What is claimed is:

1. An image forming apparatus comprising:

an image carrier;

a transfer medium facing said image carrier in a transfer region where an image is transferred to said transfer medium from said image carrier;

an electrode for applying a transfer voltage to said transfer medium at a position other than said transfer region, whereby, while said image carrier and said transfer medium are in contact with each other and driven, a toner image formed on said image carrier is transferred to said transfer medium by said transfer voltage and then transferred to a final transfer material;

an electrometer located opposite said transfer region in close proximity to said transfer region where said image carrier and said transfer medium face each other for measuring a surface potential of said transfer medium at said transfer region; and voltage control means for controlling a voltage to be applied to said electrode in response to an output of said electrometer.

2. An apparatus as claimed in claim 1, wherein said voltage control means comprises control means for controlling the voltage to be applied to said electrode in response to the output of said electrometer while said image carrier and said transfer medium are in contact with each other and driven.

3. An apparatus as claimed in claim 1, wherein said voltage control means comprises control means for controlling, while said image carrier and said transfer medium are in contact with each other and driven, the voltage to be applied to said electrode in response to the output of said electrometer at predetermined timings while said transfer medium completes one full rotation.

4. An apparatus as claimed in claim 1, wherein said voltage control means comprises control means for controlling, while said image carrier and said transfer medium are in contact with each other and driven, the voltage to be applied to said electrode in response to the output of said electrometer while said image carrier completes at least one full rotation.

5. An apparatus as claimed in claim 1, further comprising means for regulating, while said voltage control means is in operation, the surface potential of said image carrier to a predetermined potential in a region where said image carrier and said transfer medium do not contact each other.

6. An apparatus as claimed in claim 1, wherein said voltage control means comprises control means for applying a voltage to said electrode while said image carrier and said transfer medium are in contact with each other and held stationary for determining a condition in which the output of said electrometer rises, and for controlling the voltage to be applied to said electrode on the basis of the determined condition.

7. An apparatus as claimed in claim 1, wherein said voltage control means comprises control means for controlling the voltage to be applied to said electrode such that a voltage determined in association with the output of said electrometer remains constant.

8. An apparatus as claimed in claim 1, wherein said voltage control means comprises control means for comparing the output of said electrometer with an upper limit and a lower limit of a predetermined reference potential range, raising, if said output of said electrometer is lower than said lower limit, the voltage to be applied to said electrode by a predetermined value or lowering, if said output is higher than said upper limit, said voltage by said predetermined value, thereby confining said output in said reference potential range.

9. An image forming apparatus comprising:

an image carrier:

a transfer medium facing said image carrier in a transfer region where an image is transferred to said transfer medium from said image carrier;

an electrode for applying a transfer voltage to said transfer medium at a position other than said transfer region, whereby, while said image carrier and said transfer medium are in contact with each other and driven, a toner image formed on said image carrier is transferred to said transfer medium by said transfer voltage and then transferred to a final transfer material;

a first electrometer located opposite said transfer region in close proximity to said transfer region where said image carrier and said transfer medium face each other for measuring a surface potential of said transfer medium at said transfer region;

a second electrometer located upstream of said transfer region of said image carrier for measuring the surface potential of said image carrier;

correcting means for correcting the output of said first electrometer based on an output of said second electrometer; and voltage control means for controlling the voltage to be applied to said electrode in response to the corrected output of said correcting means.

10. An image forming apparatus comprising:

an image carrier;

a transfer medium facing said image carrier in a transfer region where an image is transferred to said transfer medium from said image carrier;

an electrode for applying a transfer voltage to said transfer medium at a position other than said transfer region, whereby, while said image carrier and said transfer medium are in contact with each other and driven, a toner image formed on said image carrier is transferred to said transfer medium by said transfer voltage and then transferred to a final transfer material;

an electrometer located in close proximity to said transfer region where said image carrier and said transfer medium face each other for measuring a surface potential of said transfer region;

correcting means for correcting the output of said electrometer based on the application of a voltage to said electrode and based on the output of said electrometer before the application of said voltage; and voltage control means for controlling the voltage to be applied to said electrode on the basis of the corrected output of said correcting means.

11. An image forming apparatus comprising:

an image carrier;

a transfer medium facing said image carrier in a transfer region where an image is transferred to said transfer medium from said image carrier;

an electrode for applying a transfer voltage to said transfer medium at a position other than said transfer region, whereby, while said image carrier and said transfer medium are in contact with each other and driven, a toner image formed on said image carrier is transferred to said transfer medium by said transfer voltage and then transferred to a final transfer material;

an electrometer located opposite said transfer region in close proximity to said transfer region where said image carrier and said transfer medium face each other for measuring a surface potential of said transfer medium at said transfer region, said electrometer being located on a side opposite to a side where said transfer medium contacts said image carrier; and voltage control means for controlling a voltage to be applied to said electrode in response to an output of said electrometer.

12. An apparatus as claimed in claim 11, wherein said electrode applies the transfer voltage to said transfer medium in contact with a side of said transfer medium opposite to a side contacting said image carrier.

13. An apparatus as claimed in claim 11, wherein said electrode is configured as a roller.

* * * * *